US011686304B2

(12) United States Patent
Takahashi

(10) Patent No.: US 11,686,304 B2
(45) Date of Patent: Jun. 27, 2023

(54) RECIPROCATING COMPRESSOR-EXPANDER

(71) Applicant: MITSUI E&S MACHINERY CO., LTD., Tokyo (JP)

(72) Inventor: Motoyuki Takahashi, Okayama (JP)

(73) Assignee: MITSUI E&S MACHINERY CO., LTD., Tokyo (JP)

( * ) Notice: Subject to any disclaimer, the term of this patent is extended or adjusted under 35 U.S.C. 154(b) by 302 days.

(21) Appl. No.: 17/038,046

(22) Filed: Sep. 30, 2020

(65) Prior Publication Data

US 2021/0180588 A1 Jun. 17, 2021

(30) Foreign Application Priority Data

Dec. 17, 2019 (JP) ..... 2019-227516

(51) Int. Cl.
*F04B 53/10* (2006.01)
*F04B 53/00* (2006.01)
(Continued)

(52) U.S. Cl.
CPC ..... *F04B 53/10* (2013.01); *F04B 39/0094* (2013.01); *F04B 39/10* (2013.01);
(Continued)

(58) Field of Classification Search
CPC ..... F04B 53/10; F04B 39/10; F04B 53/006; F04B 53/14; F04B 53/16; F04B 7/0042;
(Continued)

(56) References Cited

U.S. PATENT DOCUMENTS 6,443,717 B1 * 9/2002 Barber ..... F04B 7/0007 429/444
2011/0115223 A1 * 5/2011 Stahlkopf ..... H02P 9/04 290/7
(Continued)

FOREIGN PATENT DOCUMENTS

JP H02130278 A 5/1990
JP H0749011 A 2/1995
(Continued)

OTHER PUBLICATIONS

JPO Notice of Reasons for Refusal for corresponding JP Application No. 2019-227516; dated Sep. 2, 2020.
(Continued)

*Primary Examiner* — Kenneth J Hansen
*Assistant Examiner* — David N Brandt
(74) *Attorney, Agent, or Firm* — Cantor Colburn LLP

(57) ABSTRACT

A reciprocating compressor-expander according to the present invention comprises a cylinder, a piston, a crankshaft connected to the piston, a first valve for a low pressure compressible fluid, a second valve for a high pressure compressible fluid, and a valve drive mechanism for driving the first valve and the second respectively such that, during a compression process, the low-pressure compressible fluid is sucked into the cylinder from the first valve in synchronization with the rotation of the crankshaft and the high-pressure compressible fluid compressed in the cylinder is discharged from the second valve, and that, during an expansion process, the high-pressure compressive fluid is introduced from the second valve into the cylinder, and the low-pressure compressible fluid expanded in the cylinder is discharged from the first valve.

4 Claims, 9 Drawing Sheets

(51) Int. Cl.

| | |
|---|---|
| ***F04B 39/10*** | (2006.01) |
| ***F04B 39/00*** | (2006.01) |
| ***F04B 35/04*** | (2006.01) |
| ***F04B 39/08*** | (2006.01) |
| ***F04B 49/00*** | (2006.01) |
| ***F04B 49/22*** | (2006.01) |
| ***F04B 7/02*** | (2006.01) |
| ***F04B 7/00*** | (2006.01) |

(52) U.S. Cl.
CPC ..... *F04B 53/006* (2013.01); *F04B 7/0053* (2013.01); *F04B 7/0225* (2013.01); *F04B 7/0266* (2013.01); *F04B 35/04* (2013.01); *F04B 39/08* (2013.01); *F04B 49/002* (2013.01); *F04B 49/22* (2013.01); *F04B 2201/0601* (2013.01)

(58) Field of Classification Search
CPC ..... F04B 7/0053; F04B 7/02; F04B 7/0225; F04B 7/0266; F04B 35/04; F04B 39/08; F04B 49/002; F04B 49/22; F04B 2201/0601
See application file for complete search history.

(56) References Cited

U.S. PATENT DOCUMENTS

| | | | | |
|---|---|---|---|---|
| 2012/0023918 | A1* | 2/2012 | Laird | F04B 7/0042 60/459 |
| 2012/0285554 | A1* | 11/2012 | Lohkamp | F04B 39/10 137/565.11 |
| 2013/0118344 | A1* | 5/2013 | Howes | F04B 49/22 91/55 |
| 2017/0159682 | A1* | 6/2017 | Saadat | F04B 35/01 |

FOREIGN PATENT DOCUMENTS

| | | | | |
|---|---|---|---|---|
| JP | 2001303995 | A | 10/2001 | |
| JP | 2003286952 | A | 10/2003 | |
| JP | 2013533427 | A | 8/2013 | |
| WO | WO-2015112025 | A1 * | 7/2015 | F04B 49/065 |

OTHER PUBLICATIONS

JPO Notice of Reasons for Refusal for JP Application No. 2019-227516; dated Jun. 3, 2020.

* cited by examiner

PV Diagram

PV Diagram

RECIPROCATING COMPRESSOR-EXPANDER

CROSS-REFERENCE TO RELATED APPLICATIONS

The present invention claims priority under 35 U.S.C. § 119 to Japanese Patent Application No. 2019-227516 filed on Dec. 17, 2019, the entire content of which is incorporated herein by reference.

BACKGROUND OF THE INVENTION

1. Field of the Invention

The present invention relates to a reciprocating compressor-expander suitable for use in, for example, compressing or expanding a compressible fluid.

2. Description of Related Art

Conventionally, solar power generators, wind power generators, and the like have been widely used as renewable energy generators. However, in such power generators using natural energies, since the power generation amount fluctuates greatly, it is difficult to use it effectively depending on the power demand.

This is because the amount of power generated by natural energy, which cannot be controlled by humans, sometimes exceeds the demanded power significantly to generate excessive surplus power, and in the worst case, blackout of power may occur. For this reason, in the case of a power generator using natural energy, a part of the power generator is cut off so as not to generate such excessive surplus power.

As a countermeasure against such excessive surplus power, it is conceivable to level the power by temporarily storing the surplus power in a storage battery, discharging the surplus power when the power demand is likely to increase, and supplying the power to the grid. This storage method using a storage battery is to store electrical energy directly and is ideal from the standpoint of utilization and the like, but a special metal or the like is required for the storage battery, resulting in an extremely expensive energy storage device.

Another solution for storing surplus power based on natural energy is to convert electrical energy into compressed air energy for storage. With respect to this electricity storage scheme, a pilot plant of an energy storage device by conversion into compressed air energy has been constructed, and a demonstration experiment has been completed.

In this scheme, an electric motor is operated using surplus electric power to rotationally drive a compressor which generates compressed air to store in a tank temporarily, and when electric power is insufficient, an expander is driven by the compressed air to rotationally drive a generator, whereby electric power is generated and converted into electric power again. As a result of a demonstration experiment, it has been confirmed that the overall efficiency is 60 to 70%. In an energy storage device using this method, a screw type compressor is used as a compressor-expander.

It is also known another type compressor using a piston. In such a conventional reciprocating compressor using a piston, the intake valve and the discharge valve are operated only by a simple spring force using a leaf spring or the like (see PTL 1).

However, in the conventional screw type compressor described above, the following problem is concerned. That is, in the screw type compressor, a constant gap is inevitably generated between the male and female rotors and between the rotor and the casing in terms of structure, and leakage of the object to be compressed occurs through this gap during compression, thereby decreasing compression efficiency and expansion efficiency.

When both compression process and expansion process are performed by one compressor-expander, the rotation direction of the compressor-expander is reversed in each process. Therefore, in order to simplify the power device by rotating the motor used for compression and the generator used for power generation in the same direction, some switching device or the like is required.

Further, the screw type compressor is relatively small in capacity and not suitable for large capacity energy storage devices. The screw type compressor cannot adjust the capacity thereof by the compressor-expander itself and needs to be provided with a pressure regulating device or the like of the compressed air. Further, in order to solve such problems, a converter may be required in the power grid, and in this case, there is a problem that the apparatus itself becomes expensive.

On the other hand, in the conventional reciprocating compressor, the intake valve and the discharge valve are operated by a spring such as a leaf spring as described above, and in this case, the intake valve and the discharge valve are operated only by a preset spring force due to the differential pressure with the internal pressure, and there is a problem that it is not always easy to arbitrarily and optimally adjust the intake flow rate and the discharge flow rate. Further, there is a problem that it cannot be used also as an expander.

The present invention has been made to solve such problems, and it is an object of the present invention to provide a reciprocating compressor-expander which is extremely high in efficiency and has the same rotation direction regardless of whether it is used for compression or expansion, which is suitable for a large capacity power storage plant or the like, and which is extremely easy to adjust in capacity, and which is inexpensive because a converter is unnecessary in an electric power grid even when it is used for the power storage plant.

CITATION LIST

Patent Literature

PTL1: JP H2-130278 A

BRIEF SUMMARY OF THE INVENTION

According to the present invention, it is provided a reciprocating compressor-expander comprising: a cylinder; a piston sliding tightly inside the cylinder; a crankshaft connected to the piston for converting reciprocating motion of the piston and rotary motion of the crankshaft each other; a first valve for introducing or discharging a low pressure compressible fluid into or from the cylinder; a second valve for discharging or introducing a high pressure compressible fluid from or into the cylinder; and a valve drive mechanism for driving the first valve and the second valve to open and to close; wherein the valve drive mechanism is configured to drive the first valve and the second respectively such that, during a compression process, the low-pressure compressible fluid is sucked into the cylinder from the first valve in synchronization with the rotation of the crankshaft and the high-pressure compressible fluid compressed in the cylinder is discharged from the second valve, and that, during an expansion process, the high-pressure compressive fluid is introduced from the second valve into the cylinder, and the low-pressure compressible fluid expanded in the cylinder is discharged from the first valve.

As described above, by providing the valve drive mechanism connected to the first valve and the second valve for driving the first valve and the second valve to open and to close, the reciprocating compressor-expander according to the present invention can be used for both compression and expansion, and the opening and closing operations of the first valve and the second valve can be controlled arbitrarily and optimally, while, in the conventional reciprocating compressor, the intake valve and the discharge valve are operated only by a preset spring force in relation to the internal pressure.

In addition, the piston sliding tightly inside the cylinder makes the efficiency extremely high, the rotation direction of the crankshaft become the same regardless of the compression and expansion processes, the capacity be not particularly limited to be suitable for a large-capacity power storage plant or the like, and, when used in a power storage plant, a converter be not required in an electric power grid to reduce the cost.

In the reciprocating compressor-expander, it is preferable that the valve drive mechanism includes hydraulic pistons for operating the first valve and the second valve respectively, and a hydraulic control unit for electrically controlling the operation of the hydraulic piston. With such a configuration, the opening and closing operations of the first valve and the second valve can be optimally and reliably performed by the hydraulic pressure, and the valve driving mechanism can be made simple in configuration.

Preferably, the reciprocating compressor-expander further comprises a spring for urging the first valve and the second valve to the valve closing side; and the valve drive mechanism is configured to open the first valve and the second valve respectively against the urging force of the spring. With such a configuration, the valve driving mechanism can be made simpler.

Preferably, the reciprocating compressor-expander further comprises a rotary power body connected to the crankshaft for rotationally driving the crankshaft; wherein the valve drive mechanism is configured to control a load against the rotary power body by adjusting the valve opening period of the first valve during compression of the low-pressure compressible fluid by the piston. With such a configuration, the adjustment of the rotational power of the rotary power body, for example, the adjustment of the rotational power of the electric motor or the like can be performed by the valve drive mechanism, and the configuration of the rotary power body can be simplified.

Preferably, the reciprocating compressor-expander further comprises a rotary power body connected to the crankshaft for rotationally driving the crankshaft; wherein the valve drive mechanism is configured to adjust the valve opening period of the first valve during compression of the low-pressure compressible fluid by the piston so that the rotational speed of the rotary power body becomes substantially constant. With such a configuration, the adjustment of the rotational power of the rotary power body, for example, the adjustment of the rotational power of the electric motor or the like can be performed by the valve drive mechanism, and the configuration of the rotary power body can be simplified.

In the reciprocating compressor-expander, it is desirable that he valve drive mechanism is configured to adjust the opening period of the first valve by changing the transition timing from open to close of the first valve. With such a configuration, the adjustment of the valve opening period of the first valve by the valve driving mechanism is further simplified, and the adjustment of the rotational power of the rotary power body is further facilitated.

Preferably, the reciprocating compressor-expander further comprises a rotary body connected to the crankshaft to be driven rotationally by the crankshaft; wherein the valve drive mechanism is configured to control a rotational driving power to the rotary body by adjusting the valve opening period of the second valve during expansion of the high-pressure compressible fluid by the piston. With such a configuration, the adjustment of the rotational power of the rotary body, for example, the adjustment of the rotational power of a generator or the like can be performed by the valve drive mechanism, and the configuration of the rotary body can be simplified.

Preferably, the reciprocating compressor-expander further comprises a rotary body connected to the crankshaft to be driven rotationally by the crankshaft; wherein the valve drive mechanism is configured to adjust the valve opening period of the second valve during expansion of the high-pressure compressible fluid by the piston so that the rotational speed of the rotary body becomes substantially constant. With such a configuration, the adjustment of the rotational power of the rotary body, for example, the adjustment of the rotational power of a generator or the like can be performed by the valve drive mechanism, and the configuration of the rotary body can be simplified.

In the reciprocating compressor-expander described above, it is preferable that the valve drive mechanism is configured to adjust the opening period of the second valve by changing the transition timing from open to close of the second valve. With such a configuration, the adjustment of the valve opening period of the second valve by the valve driving mechanism is further simplified, and the adjustment of the rotational power to the rotary body is further facilitated.

In the reciprocating compressor-expander described above, it is preferable that the valve drive mechanism adjusts the opening/closing timing of the first valve and the second valve every time the crankshaft rotates. With such a configuration, the rotational power receiving from the rotary power body or supplying to the rotary body can be adjusted in detail by the valve drive mechanism.

Preferably, the reciprocating compressor-expander further comprises a crank angle detection sensor for detecting the rotation angle of the crankshaft, wherein the valve drive mechanism controls the operation of the first valve and the second valve based on the rotation angle of the crankshaft detected by the crank angle detection sensor. With this configuration, the valve drive mechanism can accurately control the operation of the first valve and the second valve with respect to the rotation angle of the crankshaft.

Preferably, the reciprocating compression expander further comprises a fluid pressure detecting sensor for detecting the pressure of the compressible fluid, wherein the valve driving mechanism controls the operation of the first valve and the second valve based on the pressure of the compressible fluid detected by the fluid pressure detecting sensor. With such a configuration, the valve drive mechanism can optimally control the operation of the first valve and the second valve in accordance with the pressure of the compressible fluid.

Preferably, the reciprocating compression expander further comprises a rotational power detection sensor for detecting the rotational power of the rotary body, wherein the valve drive mechanism controls the operation of the first valve and the second valve based on the rotational power detected by the rotational power detection sensor. With such a configuration, the valve drive mechanism can optimally control the operation of the first valve and the second valve in accordance with the rotational power of the rotary body, for example, the rotational power of the generator or the like.

According to the present invention, it is provided a reciprocating compressor-expander which is extremely high in efficiency and has the same rotation direction regardless of whether it is used for compression or expansion, which is suitable for a large capacity power storage plant or the like, and which is extremely easy to adjust in capacity, and which is inexpensive because a converter is unnecessary in an electric power grid even when it is used for the power storage plant.

BRIEF DESCRIPTION THE SEVERAL VIEWS OF THE DRAWINGS

DETAILED DESCRIPTION OF THE INVENTION

An embodiment of a reciprocating compressor-expander according to the present invention will be now described in detail with reference to FIGS. 1 to 9.

Figure 1:
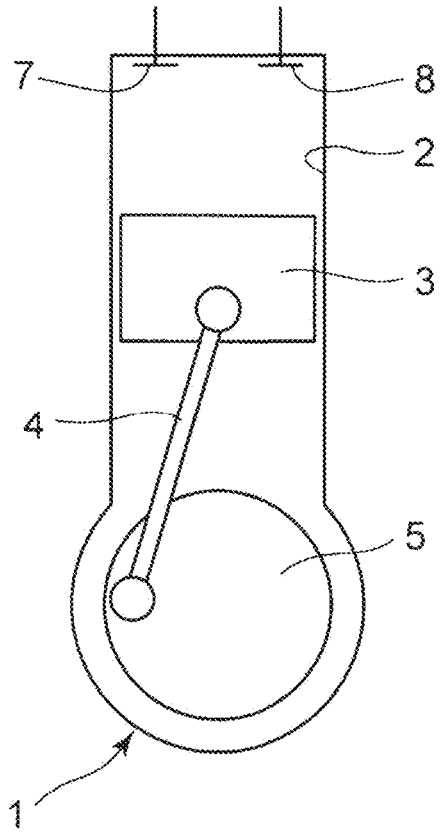
FIG. 1 is a schematic diagram showing a reciprocating compressor-expander.

As shown in FIG. 1, the reciprocating compressor-expander 1 comprises a cylinder 2, a piston 3 sliding tightly or hermetically inside the cylinder 2, a crankshaft 5 connected to the piston 3 via a connecting rod 4 for converting reciprocating motion of the piston 3 and rotary motion of the crankshaft 5 each other. The reciprocating compressor-expander 1 further comprises a first valve, hereinafter called as low-pressure valve 7, for introducing or discharging a low pressure compressible fluid into or from the cylinder 2 and a second valve, hereinafter called as high-pressure valve 8, for discharging or introducing a high pressure compressible fluid from or into the cylinder 2.

During an expansion process of the reciprocating compressor-expander 1, the high-pressure valve 8 opens to allow the high-pressure compressed air to flow into the cylinder 2, while the low-pressure valve 7 opens to allow the air, which flows in from the high-pressure valve 8, is expanded by the operation of the piston 3 and becomes low pressure, is discharged out of the cylinder 2.

Figure 2:
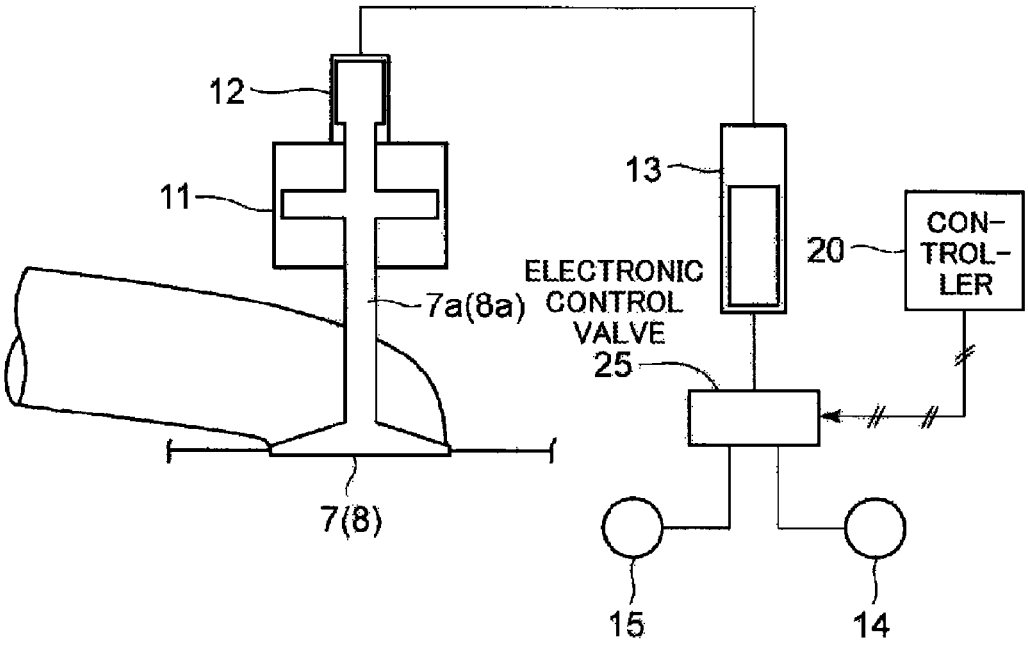
FIG. 2 is a simplified diagram showing a valve and a valve drive mechanism of a reciprocating compressor-expander according to the present invention.

As shown in FIG. 2, an air spring 11 for urging the low-pressure valve 7 toward the valve closing side is provided on the valve shaft 7*a* of the low-pressure valve 7. A hydraulic cylinder 12 is directly connected to the valve shaft 7*a* of the low-pressure valve 7 via the air spring 11. That is, when hydraulic pressure is applied to the hydraulic cylinder 12, the hydraulic cylinder 12 directly opens the low-pressure valve 7 against the urging force of the air spring 11.

At the upstream of the hydraulic cylinder 12, there is provided a hydraulic actuator 13 the operation of which is controlled by an electronic control valve 25. The operation of the electronic control valve 25 is electrically controlled by a controller 20. The electronic control valve 25 is supplied hydraulic pressure from the inlet hydraulic main pipe 14, and discharges it through an outlet hydraulic main pipe 15.

The high-pressure valve 8 is also provided, similarly to the low-pressure valve 7, with an air spring 11, a hydraulic cylinder 12, and the like separately from the low-pressure valve 7. The low-pressure valve 7 and the high-pressure valve 8 are operated independently of each other under the control of the controller 20. That is, the low-pressure valve 7 and the high-pressure valve 8 are opened and closed independently of each other on a hydraulic mechanism. However, depending on a program in the controller 20, both may be operated in some form in association with each other.

As described above, the hydraulic cylinder 12 is directly connected to the valve shaft 7*a* of the low-pressure valve 7 and a valve shaft 8*a* of the high-pressure valve 8 to directly open the low-pressure valve 7 and the high-pressure valve 8, respectively. Therefore, opening and closing operations of the low-pressure valve 7 and the high-pressure valve 8 are performed extremely quickly and reliably as instructed by the controller 20.

The air spring 11, the hydraulic cylinder 12, the hydraulic actuator 13, the electronic control valve 25, and the controller 20 form a hydraulically driven valve drive mechanism, and the hydraulic cylinder 12, the hydraulic actuator 13, the electronic control valve 25, and the controller 20 form a hydraulic control unit of the valve drive mechanism.

Figure 5:
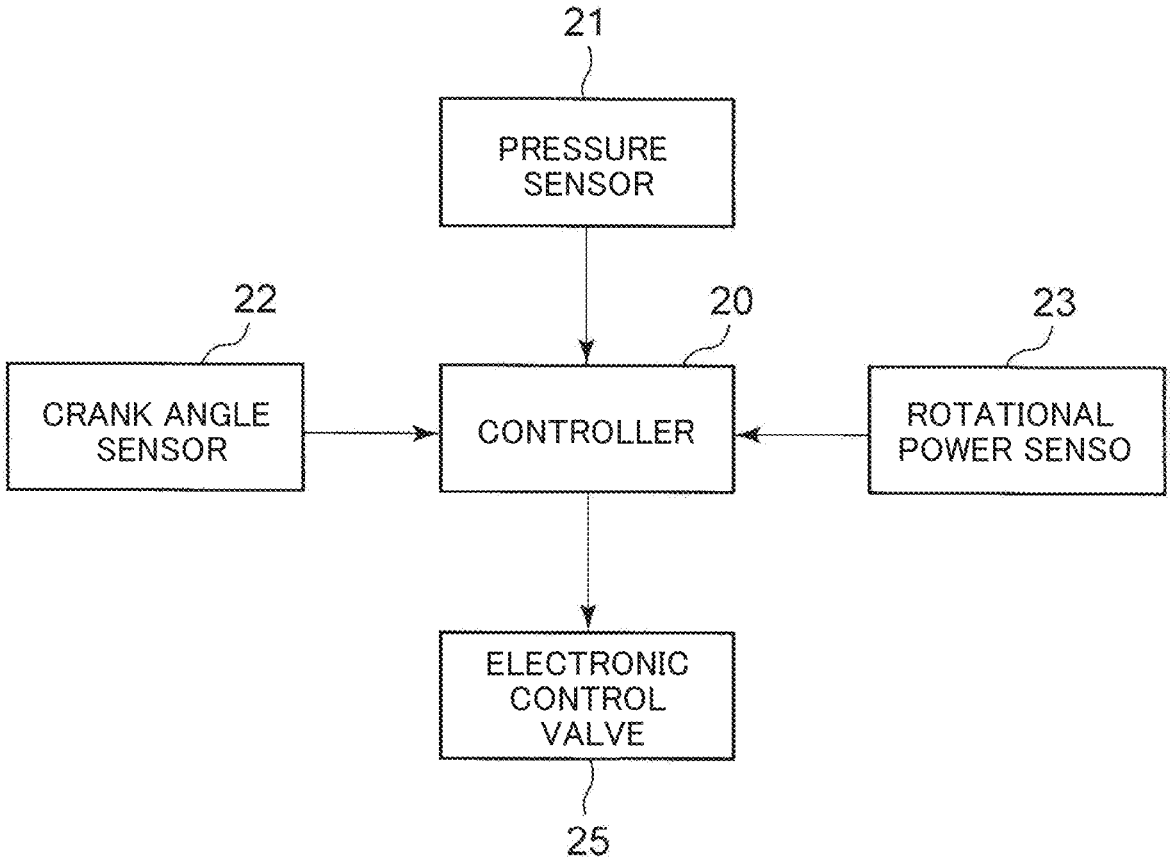
FIG. 5 is a simplified diagram showing a relationship between a controller and each sensor.

As shown in FIG. 5, a crank angle sensor 22 for detecting the rotation angle of the crankshaft 5, a compressed air tank internal pressure sensor or pressure sensor 21 for detecting the air pressure in a compressed air tank 33, and an electric power sensor or rotational power sensor 23 for detecting the rotational power of a motor-generator 31 when operating as a generator, which will be described later, are electrically connected to the controller 20. The controller 20 controls the operation of the electronic control valve 25 based on the respective parameters detected by the sensors 21, 22 and 23, and makes the low-pressure valve 7 and the high-pressure valve 8 of the present reciprocating compressor-expander 1 open and close independently of each other via the hydraulic actuator 13 and the hydraulic cylinder 12.

As shown in FIG. 2, when the low-pressure valve 7 or the low-pressure valve 8 of the reciprocating compressor-expander 1 is closed, the low-pressure valve 7 or the high-pressure valve 8 is closed by the urging force of the air spring 11 because the hydraulic pressure is not supplied to the hydraulic piston 12 from the hydraulic actuator 13. When the controller 20 electrically sends an instruction to open the valve to the electronic control valve 25, the electronic control valve 25 operates the hydraulic actuator 13 by the hydraulic pressure supplied from the inlet hydraulic pressure main pipe 14 to supply the hydraulic pressure to the hydraulic piston 12. As a result, the low-pressure valve 7 or the high-pressure valve 8 is opened against the urging force of the air spring 11.

When the controller 20 electrically sends an instruction to close the valve to the electronic control valve 25, the electronic control valve 25 operates the hydraulic actuator 13 to shut off the supply of the hydraulic pressure to the hydraulic piston 12. As a result, the low-pressure valve 7 or the high-pressure valve 8 is closed by the urging force of the air spring 11. The hydraulic pressure is discharged from the outlet hydraulic pressure main pipe 15. In the valve drive mechanism hydraulically driven mentioned above, the opening and closing valves of the low-pressure valve 7 and the high-pressure valve 8 are controlled independently of each other by the controller 20 or the like.

Figure 3:
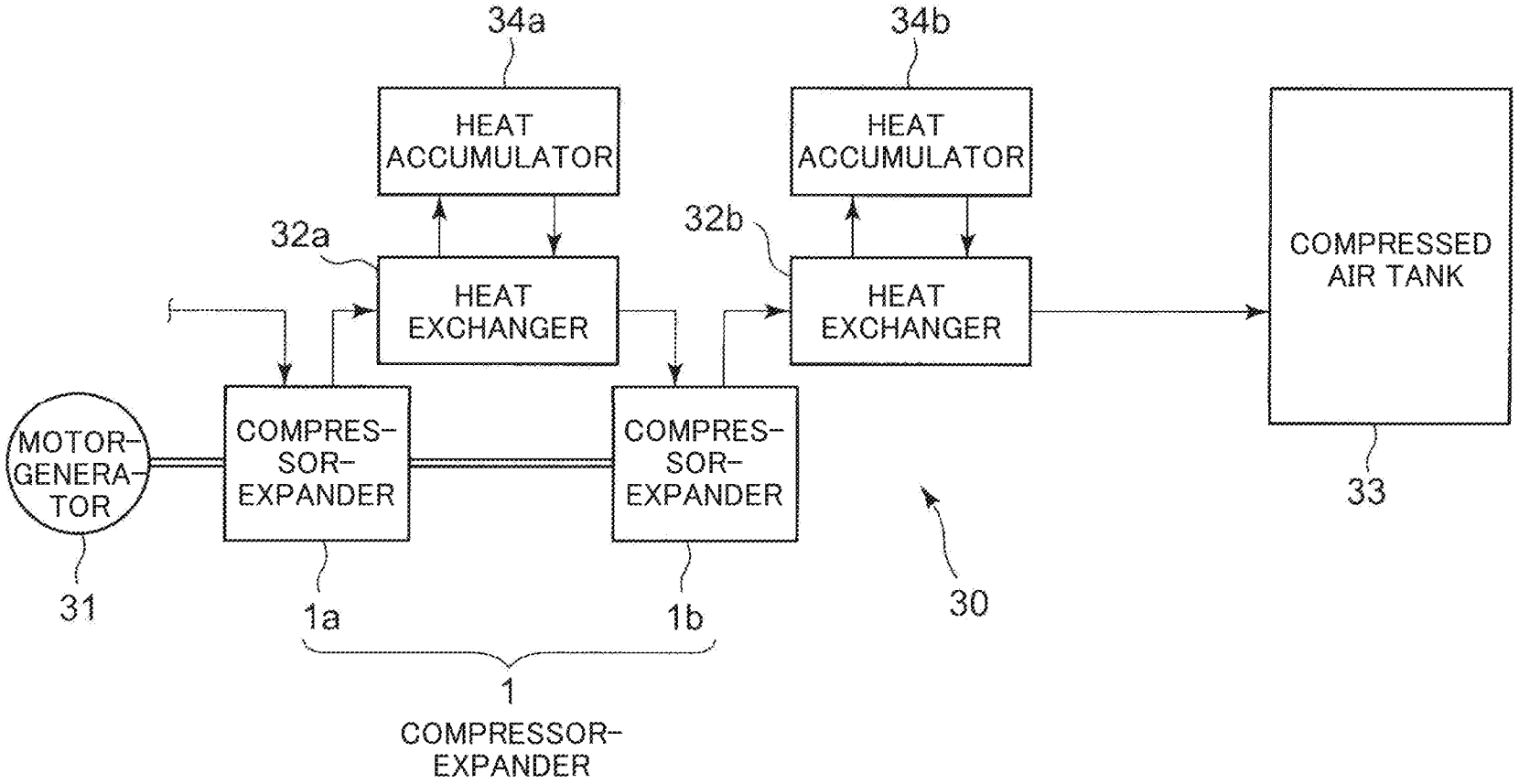
FIG. 3 is a system diagram showing a configuration of an energy storage device using the reciprocating compressor-expander shown in FIG. 2 at the time of accumulating pressure.

FIG. 3 shows an example of an energy storage device 30 using the reciprocating compressor-expander 1 in a state during a compression stroke. Two reciprocating compressor-expanders 1*a*,1*b* are arranged in series. A motor-generator 31 is connected to the rotary shaft of the connected reciprocating compressor-expanders 1*a*,1*b*. As described above, the motor-generator 31 operates as a motor that is rotationally driven by surplus electric power during the compression stroke to rotate and drive the two reciprocating compressor-expanders 1*a*,1*b*, while it is rotationally driven by the two reciprocating compressor-expanders 1*a*,1*b* during the expansion stroke to generate electric power.

A heat exchanger 32*a* is provided at the outlet of the reciprocating compressor-expander 1*a* on the low pressure side. The compressed air which has been adiabatically compressed by the operation of the piston 3 and has become high temperature is cooled by the heat exchanger 32*a*, and then sucked into the reciprocating compressor-expander 1*b* on the high pressure side from the low-pressure valve 7 thereof.

The air whose pressure has been further increased by the reciprocating compressor-expander 1*b* on the high pressure side passes through the heat exchanger 32*b* on the high pressure side, and after being reduced in temperature, is sent to the compressed air tank 33, and is stored as high pressure air energy until next power generation. The heat media of the heat exchangers 32*a* and 32*b* on the low temperature side and the high temperature side, which have been heat-exchanged, store the absorbed heat energy in the heat accumulators 34*a* and 34*b*, respectively.

Figure 4:
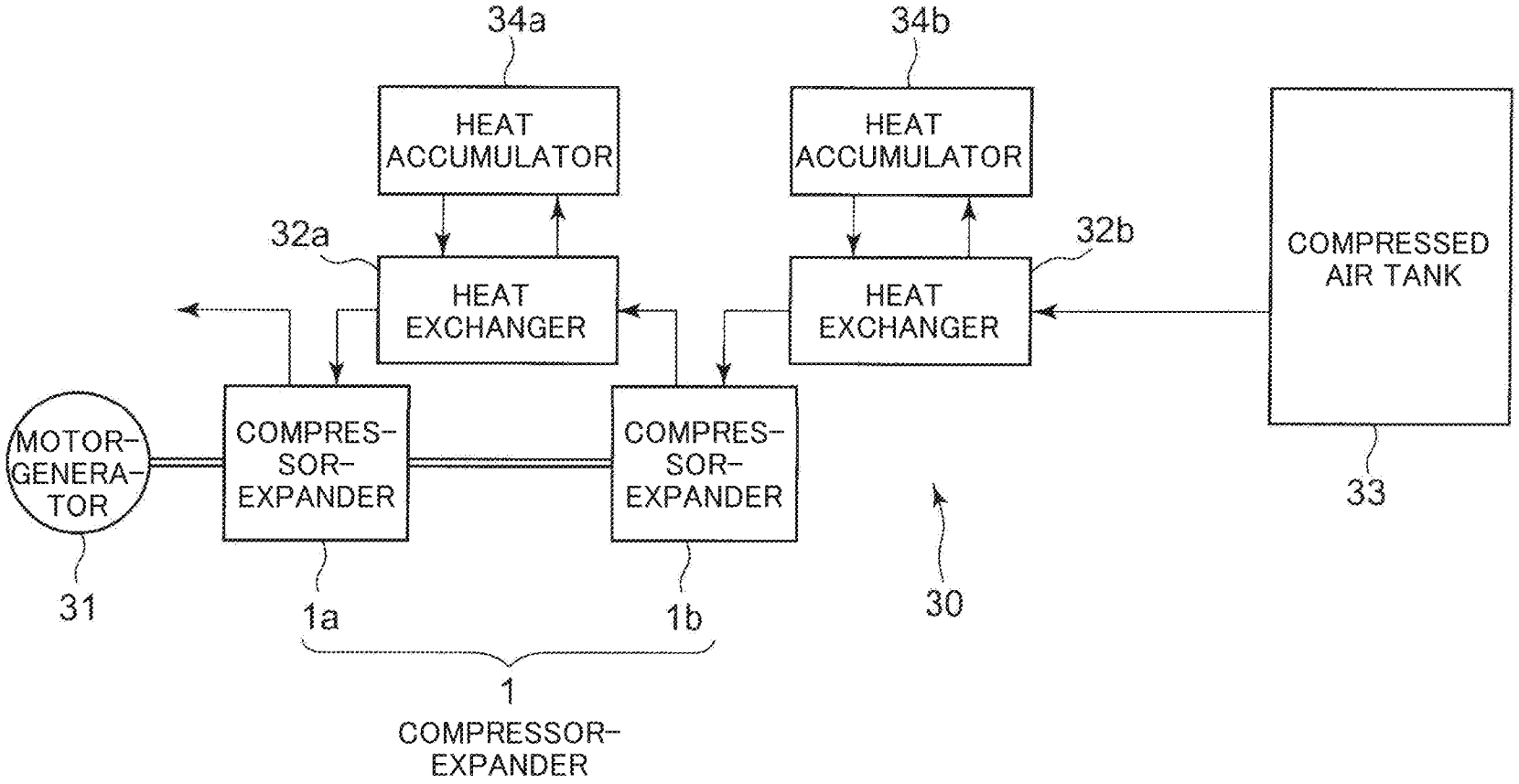
FIG. 4 is a system diagram showing a configuration of an energy storage device using the reciprocating compressor-expander shown in FIG. 2 at the time of power generation.

FIG. 4 shows the energy storage device 30 in a state during an expansion stroke. The high-pressure air stored in the compressed air tank 33 is sent to the heat exchanger 32*b* on the high-pressure side when electric power is required, and after the temperature is raised by the thermal energy from the heat accumulator 34*b*, the high-pressure air flows into the cylinder 2 from the high-pressure valve 8 of the reciprocating compressor-expander 1*b* on the high-pressure side, and is adiabatically expanded by the operation of the pistons 3 to lower the pressure and temperature.

The compressed air whose pressure and temperature are lowered is discharged from the low-pressure valve 7 of the reciprocating compressor-expander 1*b* on the high pressure side, passes through the heat exchanger 32*a* on the low pressure side, rises in temperature by thermal energy from the heat accumulator 34*a* on the low pressure side, flows into the cylinder 2 from the high-pressure valve 8 of the reciprocating compressor-expander 1*a* on the low pressure side, and adiabatically expands by the operation of the pistons 3, thereby further lowering the pressure and temperature.

The compressed air whose pressure and temperature are lowered is discharged to the outside from the low-pressure valve 7 of the reciprocating compression expander 1*a* on the low pressure side. On the other hand, by the operation of the pistons 3 of the two reciprocating compressor-expanders 1*a* and 1*b*, the crankshaft 5 is rotationally driven to drive the motor-generator 31 rotationally, whereby electric power is regenerated. As a result, the pressure energy once converted into the high-pressure compressed air and stored therein is regenerated into electrical energy again.

As described above, in the reciprocating compressor-expander 1, the crankshaft 5 is rotationally driven by the motor-generator 31 operating with surplus electric power, high-pressure compressed air is formed by adiabatic compression by the operation of the piston 3, and the crankshaft 5 is rotationally driven by adiabatic expansion of the formed high-pressure compressed air, whereby electric power is regenerated by the motor-generator 31.

Figure 6:
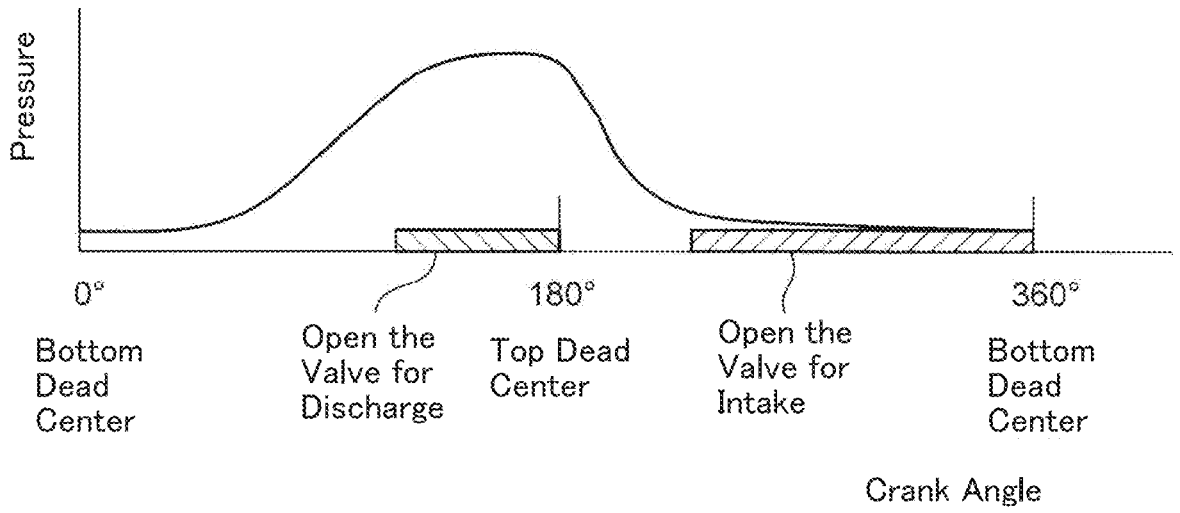
FIG. 6 is a graph showing a relationship between the crank angle and the air pressure in the cylinder during a compression stroke of the reciprocating compressor-expander shown in FIG. 2.

As shown in FIG. 6, during the compression stroke of the reciprocating compressor-regenerator 1, the controller 20 opens the low-pressure valve 7 at a crank angle of about 230 to 270 deg. and closes it at about 310 to 360 deg., while opening the high-pressure valve 8 at a crank angle of about 110 to 140 deg. and closing it at about 180 to 210 deg. The crank angle is 0 or 360 deg. at the bottom dead center and 180 deg. at the top dead center.

In particular, in the reciprocating compressor-expander 1, the rotational power of the motor-generator 31 is adjusted by changing the valve opening period of the low-pressure valve 7, more specifically, the transition timing from the valve opening to the valve closing during the compression stroke by the piston 3.

By configured so, the adjustment of the rotational power of the motor-generator 31 can be performed by the controller 20 on the valve drive mechanism side, and the electric control on the motor-generator 31 side can be simplified. For this reason, the controller 20 further changes the valve opening period of the low-pressure valve 7, more specifically, the transition timing of the low-pressure valve 7 from the valve opening to the valve closing, so that the rotational speed of the motor-generator 31 becomes substantially constant during the compression stroke by the piston 3.

Figure 7:
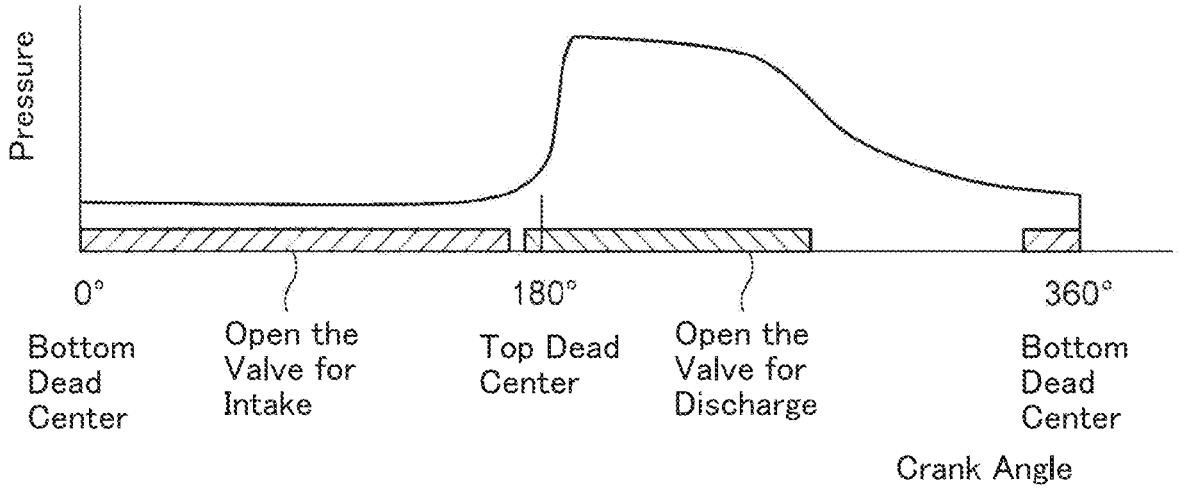
FIG. 7 is a graph showing a relationship between the crank angle and the air pressures in the cylinder during an expansion stroke of the reciprocating compressor-expander shown in FIG. 2.

As shown in FIG. 7, during the expansion stroke of the reciprocating compressor-expander 1, the controller 20 opens the high-pressure valve 8 for flowing high-pressure air at a crank angle of about 160 to 180 deg., and closes the valve at about 220 to 270 deg., while opening the high-pressure valve 8 at a crank angle of about 310 to 360 deg., and closes the valve at about 120 to 180 deg.

In particular, in the reciprocating compressor-expander 1, the rotational power of the motor-generator 31 that operates as a generator is adjusted by changing the valve opening period of the high-pressure valve 8, more specifically, the timing of the transition from the valve opening to the valve closing during the expansion stroke by the piston 3. By configured so, the adjustment of the rotational power of the motor-generator 31 can be performed by the controller 20 on the valve drive mechanism side, and the electric control on the motor-generator 31 side which operates as a generator can be simplified.

For this reason, the controller 20 further changes the valve opening period of the high-pressure valve 8, more specifically, the transition timing from the valve opening to the valve closing, so that the rotational speed of the motor-generator 31 becomes substantially constant during the expansion stroke by the piston 3.

Figure 8:
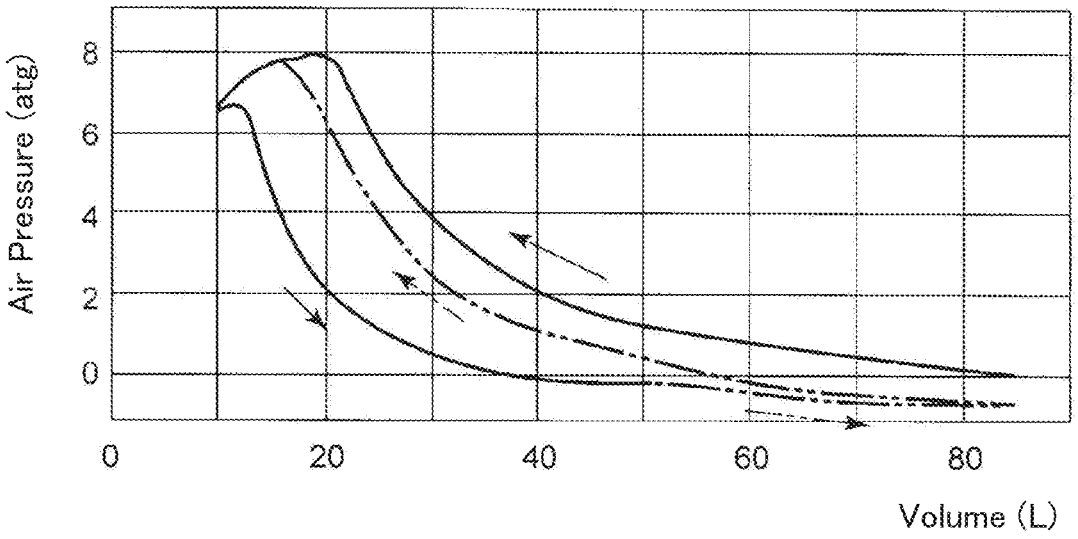
FIG. 8 is a PV diagram showing a relationship between cylinder internal volume V and air pressures P during a compression stroke of the reciprocating compressor-expander shown in FIG. 2.
Figure 9:
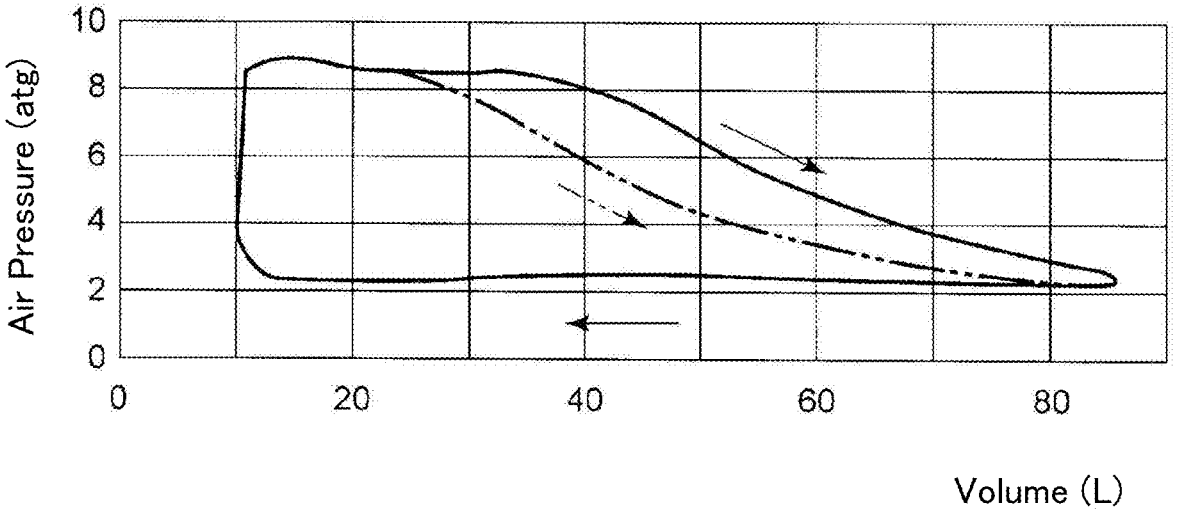
FIG. 9 is a PV diagram showing a relationship between cylinder internal volume V and air pressure P during an expansion stroke of the reciprocating compressor-expander shown in FIG. 2.

In FIG. 8 and FIG. 9, the two-dot broken line is a PV diagram showing the relationship between the inflow air volume and the air pressure in the cylinder when the valve opening period is shortened by making the transition timing of the high-pressure valve 8 from the valve opening to the valve closing earlier than in the case of the solid line.

As described above, by changing the transition timing of the high-pressure valve 8 from the opening to the closing, the work amount generated by the reciprocating compressor-expander 1 is changed, whereby the work amount and the power amount generated by the motor generator 31 are changed. That is, in the energy storage device 30 using the reciprocating compressor-expander 1 described above, the adjustment of the work amount and the power generation amount by the motor-generator 31 is extremely easily performed by the controller 20 on the valve drive mechanism side, not on the motor-generator 31 side.

Further, the controller 20 adjusts the opening and closing timing of the low-pressure valve 7 and the high-pressure valve 8 of the reciprocating compressor-expander 1 every time the crankshaft 5 rotates. Therefore, the rotational power of the motor-generator 31 can be finely adjusted by the controller 20.

As described above, in the reciprocating compressor-expander 1, the opening and closing operations of the low-pressure valve 7 and the high-pressure valve 8 are arbitrarily and optimally controlled by the above-mentioned hydraulically driven valve drive mechanism, while in the conventional reciprocating compressor, the intake valve and the discharge valve are operated only by the preset spring force in relation to the internal pressure of the cylinder.

The reciprocating compressor-expander 1 has various advantages, such as: since the piston 3 slides hermetically in the cylinder 2, the compression efficiency and expansion efficiency is extremely high; since the reciprocating compressor-expander 1 operates reciprocally, the rotational direction of the crankshaft 5 even when used in any of the compression and expansion stroke becomes the same; since there is no particular limitation on capacity, it is suitable for large-capacity power storage plants or the like; and if it is used in an energy storage device in a power grid, no converter is needed in the power grid to make it inexpensive.

The valve drive mechanism may be formed by an electrically driven valve drive mechanism instead of the hydraulically driven valve drive mechanism as described above. In such an electrically driven valve drive mechanism, for example, the low-pressure valve 7 and the high-pressure valve 8 are directly opened and closed by an electrically driven actuator or the like, and the operation of the electrically driven actuator is electrically controlled by the same controller as described above, thereby making it possible to form an electrically driven valve drive mechanism.

The reciprocating compressor-expander described above is merely an example, and various modifications are possible based on the scope of the present invention, and they are not excluded from the scope of the present invention.

What is claimed is:

1. A reciprocating compressor-expander comprising:

a cylinder;

a piston sliding tightly inside the cylinder;

a crankshaft converting reciprocating motion of the piston and rotary motion of the crankshaft to each other;

a first valve that opens when introducing a compressible fluid into the cylinder during a compression process for the compressible fluid or when discharging an expanded compressible fluid in the cylinder during an expansion process for the compressible fluid;

a second valve that opens when the compressible fluid compressed in the cylinder during the compression process is discharged or when the compressible fluid is introduced into the cylinder during the expansion process;

a hydraulic cylinder connected to each of the first valve and the second valve;

actuators connected to each of the hydraulic cylinders;

a controller capable of opening and closing the first valve and the second valve individually by electrically controlling each of the actuators;

a motor generator that generates electricity when the crankshaft is driven to rotate based on the reciprocating motion of the piston and also drives the crankshaft to rotate to reciprocate the piston;

an angle sensor to detect an angle of rotation of the crankshaft; and a power sensor that detects a rotational power of the motor generator; wherein the controller adjusts an amount of work in the motor generator by adjusting an opening period of at least one of the first valve or the second valve based on detection signals from the angle sensor and the power sensor.

2. The reciprocating compressor-expander as claimed in claim 1, further comprising a spring for urging the first valve and the second valve to a valve closing side; and the first valve and the second valve are each opened against a biasing force of the spring when the actuator is operated by the controller.

3. The reciprocating compressor-expander as claimed in claim 1, wherein the controller adjusts the valve opening period of at least one of the first valve and the second valve so that a rotational speed of the motor generator is substantially constant.

4. The reciprocating compressor-expander as claimed in claim 1, wherein the controller adjusts the opening period or a closing period of at least one of the first valve or the second valve for each rotation of the crankshaft.

* * * * *